United States Patent [19]

Goodman et al.

[11] Patent Number: 4,928,443

[45] Date of Patent: May 29, 1990

[54] POURABLE SEALER POCKET

[75] Inventors: Ronald L. Goodman; Richard E. Kelley, Sr., both of Carlisle, Pa.

[73] Assignee: Carlisle Corporation, Cincinnati, Ohio

[21] Appl. No.: 317,540

[22] Filed: Mar. 1, 1989

[51] Int. Cl.[5] ..... E04D 1/36

[52] U.S. Cl. ..... 52/58; 52/60; 52/219

[58] Field of Search ..... 52/58–61, 52/219, 218; 285/42, 419, DIG. 16; 138/109, 155–162

[56] References Cited

U.S. PATENT DOCUMENTS

| | | | |
|---|---|---|---|
| 1,406,469 | 2/1922 | McGraw . | |
| 2,054,308 | 9/1936 | Tucker . | |
| 3,247,636 | 4/1966 | Mick et al. . | |
| 3,708,185 | 1/1973 | Bilicki et al. . | |
| 3,838,544 | 10/1974 | Hindall . | |
| 3,871,145 | 3/1975 | Hatmaker . | |
| 4,248,926 | 2/1981 | Tajima et al. . | |
| 4,461,875 | 7/1984 | Crepeau . | |
| 4,544,593 | 10/1985 | Borgert et al. . | |
| 4,635,409 | 1/1987 | Vandemore . | |
| 4,730,421 | 3/1988 | Leeland . | |
| 4,799,986 | 1/1989 | Jann | 52/58 X |

OTHER PUBLICATIONS

American Builder, p. 112, "Plastic Flashing Solves Difficult Sealing Jobs".

U-16D Pourable Sealer Pocket, Carlisle SynTec Systems.

U-16A Pourable Sealer Pocket, Carlisle SynTec Systems.

U-16B Pourable Sealer Pocket, Carlisle SynTec Systems.

U-16C Pourable Sealer Pocket, Carlisle SynTec Systems.

*Primary Examiner*—Richard E. Chilcot, Jr.

*Attorney, Agent, or Firm*—Wood, Herron & Evans

[57] ABSTRACT

A one piece pourable sealer pocket includes a flexible support strip bonded to a strectchable water impervious membrane strip. The membrane strip has an exterior surface which is not tacky and an interior surface which is tacky. A portion of the membrane strip extends above the collar and a portion extends below the collar. In application, the collar is fastened surrounding a projection in a roof and the lower portion of the membrane is stretched to form an annular flange around the collar bonded to the roof surface. The upper portion of the membrane strip bends over the collar to form a continuous upper water impervious barrier around the collar. This pourable sealer pocket is easy to construct and easy to apply in the field.

6 Claims, 1 Drawing Sheet

POURABLE SEALER POCKET

There are many different types of roofs such as shingled roofs, built up roofs and membrane roofs. The present invention generally relates to membrane roofs and built up roofs.

These two types of roof systems always include a water impervious upper surface completely covering the surface of the roof deck to prevent water penetration. This will be referred to as the roof membrane although it can also be tar and tar paper as in a built up roof. When needed such roofs include special features at the perimeters of the roof and along all parapet walls and penetrations in the roof to ensure that water does not circumvent the upper water impervious surface. For example, where the water impervious surface or membrane terminates at a wall flashing is employed to keep the water from circumventing the membrane at the area between the membrane and the wall.

A roof may have several penetrations extending through the roof deck. These penetrations could be, for example, plumbing vents, various pipes for fluids and the like, or metal supports for air conditioning units and ventilation units and the like. Where these penetrations extend from the roof deck through the roof membrane, special precautions must be taken to make certain that the water does not get to the roof deck through the hole in the membrane provided for this penetration.

A typical method is to employ a pourable sealer pocket. A pourable sealer pocket is basically a containment device typically formed from metal which surrounds the penetration and is filled with a pourable sealer. The sealer prevents water from flowing down the surface of the penetration to the roof deck. The pourable sealer pocket itself must then be flashed to make sure that no water enters underneath the sealer. Flashing each pourable sealer pocket is labor intensive.

There are a number of other types of pourable sealer pockets which have been employed to reduce installation labor. For example, Leeland U.S. Pat. No. 4,370,421 discloses a pourable sealer pocket which includes its own peripheral base. Hindal U.S. Pat. No. 3,838,544 discloses a pourable sealer pocket which can be formed on a roof about a projecting structure by interfitting four identical corner units. Vandemore U.S. Pat. No. 4,635,409 discloses a plural section pourable sealer pocket. These pourable sealer pockets include a water impervious skirting which is adhered to the roof using a cement or adhesive. Both of these pourable sealer pans or pockets are relatively complex and expensive to produce and not particularly easy to install.

SUMMARY OF THE INVENTION

The present invention is premised on the realization that a one section cylindrical pourable sealer pocket can be formed by the combination of a stretchable membrane strip bonded to a linear flexible collar or support. The collar has a male-female connector at either of its ends which join together to form a cylinder around a penetration through a roof membrane. The stretchable membrane strip which is simply a linear piece of stretchable membrane can then be bent out to form a flange or skirt about the formed cylinder acting as flashing for the pourable sealer pocket. The stretchable membrane strip is longer than the collar to provide an overlapping edge portion which permits a continuous impervious membrane strip to be formed around the collar.

The present invention is further premised on the realization that wherein the stretchable membrane strip includes a pressure sensitive adhesive on one side, the pourable sealer pocket can be installed by simply pressing the support collar against the strip thereby bonding it to the strip. The stretchable strip having an adhesive layer can be bonded to the roof membrane without the need for any additional adhesive application.

These advantages and other advantages of the present invention will be appreciated in light of the following detailed descriptions and figures in which:

DETAILED DESCRIPTION OF THE INVENTION

Figure 1:
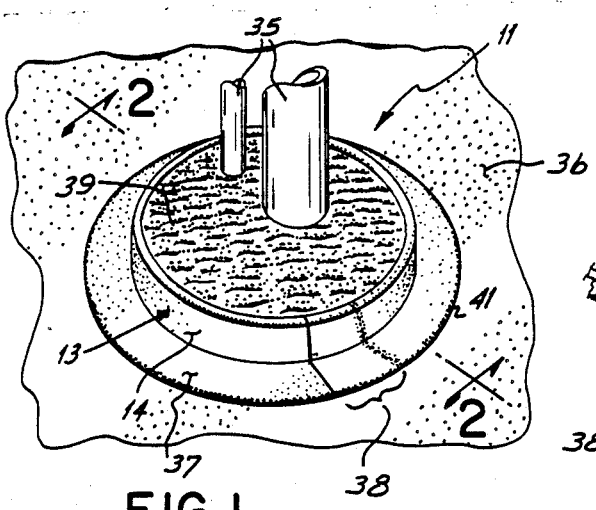
FIG. 1 is a perspective view of a pourable sealer pocket of the present invention encircling a plurality of pipes.

As shown more particularly in FIGS. 1–3A, there is a pourable sealer pocket 11 or containment device which includes a flexible collar 12 bonded to a stretchable membrane strip 13. The stretchable membrane strip includes an exterior side 14 and an interior side 15. The interior side 15 of the membrane strip 13 is bonded to an exterior side 16 of collar 12. Collar 12 likewise includes an interior side 17 as well as an upper edge 18 and a lower edge 19.

The membrane strip 13 includes an upper portion 21 which extends above the upper edge 18 of collar 12. This upper portion is at least about ½" wide. Further strip 13 includes approximately a 2.5" wide lower edge portion 22 extending beyond the lower edge 19 of collar 12. Membrane strip 13 also includes an overlapping end portion 23 which extends beyond one end 24 of the collar 12. End portion 23 should extend at least about 2–3" beyond end 24.

Figure 3A:
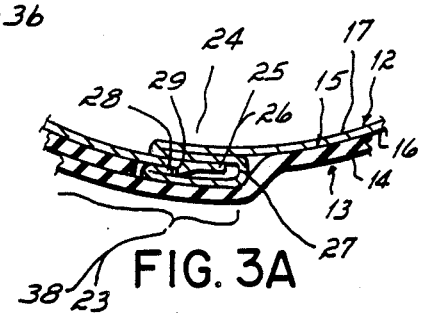
FIG. 3A is a fragmentary overhead cross-sectional view of the form shown in FIG. 3 showing the male female connector engaged.
Figure 2:
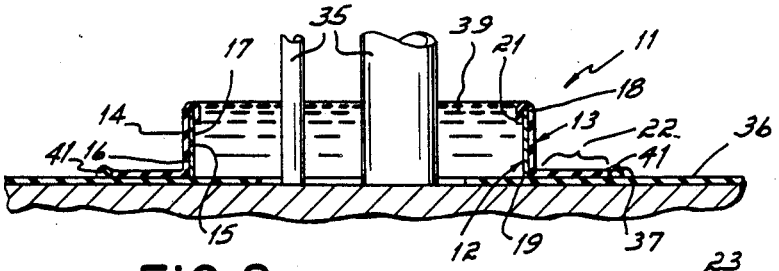
FIG. 2 is a cross-sectional view taken at lines 2—2 of FIG. 1.
Figure 3:
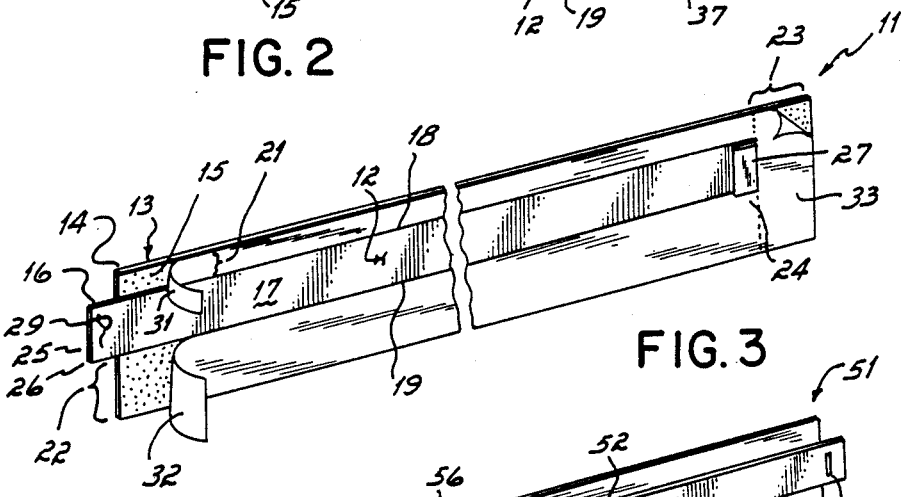
FIG. 3 is a fragmentary perspective view of a pourable sealer pocket prior to shaping, according to the present invention.

The collar 12 includes a male connector 25 at a second end 26 and a female connector 27 at the end 24. As shown in FIG. 3A, the female connector 27 has a general "N" shaped cross-sectional configuration. The extreme edge 28 of the collar 12 terminates within the female connector 27. The male connector 25 has an inwardly projecting nub which includes a contacting edge 29 designed to engage the edge 28 within female connector 27 holding ends 24 and 26 together and forming a cylinder.

The stretchable membrane strip 13 may be a very pliable strip of uncured EPDM or other polymeric material either thermoset or thermoplastic. Generally it must be able to be stretched 30 to 100% and preferably 50 to 100% to provide for ease and simplicity of application.

Preferably, the interior side 15 of the stretchable membrane is a pressure sensitive adhesive. More particularly, the membrane is preferably a material whose exterior side 14 is not tacky or adhesive and whose interior side 15 is very tacky and adhesive in nature. The membrane strip 13 is preferably a laminate whose outer side is an uncured EPDM membrane of about 0.040" thick which is bonded to a 0.030" thick layer of a pressure sensitive adhesive material.

Such a material is described, for example, in Chiu U.S. Pat. No. 4,588,637. This material is a butyl rubber based material formed from, for example, 35 parts butyl rubber, 54 parts polybutene having an average molecular weight of 1290 (H-300 sold by Amaco), 2 parts carbon black, 9 parts zinc oxide, one part sulfur, 2 parts paraquinonedioxine and 3 parts benzoyl peroxide.

Other materials are disclosed, for example, in Metcalf U.S. Pat. No. 4,601,935 which is a tacky rubbery composition formed from 40–60 parts by weight polyisobutylene having an average viscosity molecular weight of 6,000–14,000 and 60–40% parts by weight of a rubber selected from the group consisting of butyl rubber, chlorinated butyl rubber, brominated butyl rubber having a viscosity of from 18–75 and an unsaturation of from about 0.6 to about 2.5 mol percent. Another tape sealant is described in the November 1978 issue of *Adhesive Age,* pages 34–50 which discloses a partially cured resilient tape sealant formed from 60 parts butyl rubber, 40 parts chlorobutyl rubber and 100 parts carbon black, 115 parts endopole polybutene H100 along with fillers and curing agents.

Since the interior surface of this is tacky and adhesive the pourable sealer pocket 11 can be formed by simply preforming collar 12 and pressing this against the tacky inside surface 15 of membrane strip 13 so that about 2–3" of the membrane 13 remains below edge 19, about ½" to 1" remains above the upper edge 18 of the collar 12 and about 2"–3" remains behind the female connector 27. These portions provide for upper and lower portions 21 and 22 of the membrane 13 and overlapping portion 23.

Since the interior surface 15 of the membrane strip 13 is tacky it is preferable to cover this with a silicone backed release paper. Accordingly, the upper portion, lower portion and overlapping rear portion of the membrane are covered with pieces of silicone backed release paper 31, 32 and 33, respectively.

Prior to installation, the area where the pourable sealer pocket is to be applied is cleaned. The pourable sealer pocket 11 is applied to a roof membrane 36 surrounding penetrations 35 by first taking the lower portion 22 of the membrane strip 13 and bending it 180° so that the exterior portion of the membrane touches itself. The collar 12 is wrapped around the penetration and the male connector 25 is then forced into the female connector 27 forming a cylindrical form about penetrations 35. The release paper 32 bonded to the lower edge 22 of the stretchable membrane is pulled away exposing the tacky interior surface. This is then forced down against the roof membrane 36 forming a flange 37 bonded to the membrane 36. Heat may be required. Likewise, the silicone backed paper 31 and 33 covering the upper edge and the overlapping edge 23 of the membrane are removed. The overlapping membrane 23 is then bonded to the exterior surface 14 of the stretchable membrane strip 13 making a continuous fluid tight cylinder. Then, the upper edge 21 of the membrane is bent inwardly over the collar 12.

The flange, side wall and upper edge of the pourable sealer pocket includes a portion 38 of the membrane which is overlapped upon itself and adhered to itself thus forming a continuous circular pourable sealer pocket which includes self-sealing flashing or flange 37. The pourable sealer pocket which is adhered to the membrane is then filled with pourable sealer 39 which as it solidifies forms a continuous seal around the pipes 35. Lap sealant 41 is applied around the periphery of flange 37. Pourable sealers are well known and generally are thermoset materials such as urethanes or silicones. Pitch may be used for built-up roofs.

Figure 4:
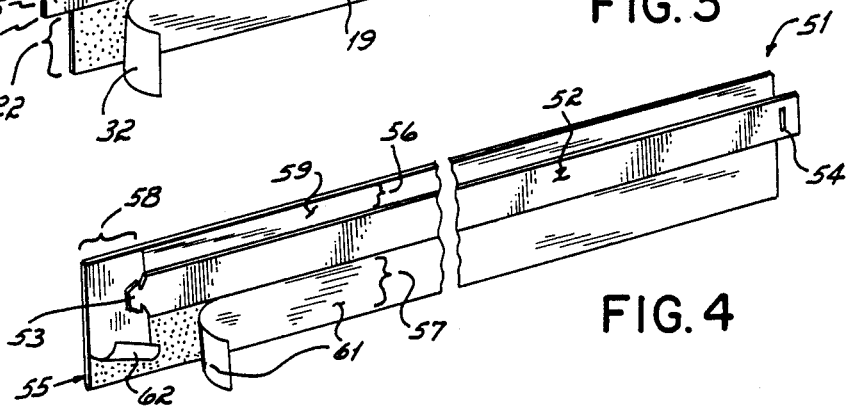
FIG. 4 is a fragmentary perspective view of an alternate embodiment of a pourable sealer pocket, prior to shaping, according to the present invention.

FIG. 4 shows an alternate embodiment of the present invention. In this embodiment the pocket 51 includes a plastic collar 52 which includes a male connector or tab 53 and a female member or slot 54 at the opposite end. This is also bonded to a stretchable membrane strip 55 which includes upper and lower portions 56 and 57 and an overlapping end portion 58 extending beyond the male connector 53. The upper and lower portions 56 and 57 of the membrane strip 55 are covered with release strips 59 and 61 and the overlapped portion 58 of the membrane 36 is likewise covered with a release strip 62 which maintains the tab 53 spaced from the tacky portion of the membrane strip 55 permitting it to be inserted within the slot 54 at the opposite end to form a cylinder similar to that shown of the membrane strip 55 permitting it to be inserted within the slot 54 at the opposite end to form a cylinder similar to that shown in FIG. 1. This alternate pourable sealer pocket is installed in the same manner as the embodiment shown in FIG. 3.

The pitch pocket of the present invention is extremely advantageous in that it is particularly easy to form or manufacture in a plant requiring relatively little cutting or bending of any metal. Since it is one piece it is extremely easy to package and distribute. Because the pourable sealer pocket is self-flashing, application is simple and labor is reduced. In conclusion, this provides an effective pourable sealer pocket which is simple to use.

The preceding has been a description of the present invention and the preferred embodiment of the present invention, however, the invention itself should be defined only by the appended claims wherein

We claim:

1. A pourable sealer pocket comprising a collar having elongated upper and lower edges, a first end and a second end and means to connect the first and second ends of the collar to form a cylinder;

a water impervious, stretchable membrane strip bonded to said collar, a first lower portion of said membrane extending below the lower edge of the collar, wherein said membrane strip is effectively stretchable to permit bending of said lower portion of said membrane normal to said collar to form an annular flange when said collar is formed into said cylinder.

2. The pourable sealer pocket claimed in claim 1 wherein said stretchable membrane strip includes an exterior side and an interior side, said interior side being a pressure sensitive adhesive.

3. The pourable sealer pocket claimed in claim 1 wherein said stretchable membrane includes a second upper portion which extends above the upper edge of said collar.

4. The pourable sealer pocket claimed in claim 1 wherein said membrane includes an overlapping edge portion extending beyond the rear end of said collar.

5. The pourable sealer pocket claimed in claim 1 wherein said flexible membrane strip includes a pressure sensitive adhesive interior side and wherein said collar is bonded to said interior side.

6. A pourable sealer pocket comprising a collar having elongated upper and lower edges, a first end and a second end and means to connect the first and second ends of the collar together to form a cylinder;

a water impervious stretchable membrane strip bonded to said collar, said membrane comprising a rubber strip which is tacky on an interior side, said collar bonded to said interior side, said membrane including a lower portion extending below the lower edge of said collar and an upper portion extending above the upper edge of said collar, an overlapping edge portion which extends beyond either said front section or said rear section of said collar;

wherein said membrane strip is effectively stretchable to permit the lower portion of the membrane to be bent normal to the collar when the collar is formed into said cylinder.

* * * * *